US006927754B2

(12) United States Patent
Lai

(10) Patent No.: US 6,927,754 B2
(45) Date of Patent: Aug. 9, 2005

(54) METHOD AND APPARATUS FOR IMPROVING RESOLUTION OF DISPLAY UNIT

(75) Inventor: Chih-Chang Lai, Taiping (TW)

(73) Assignee: Wintek Corporation, Taichung (TW)

( * ) Notice: Subject to any disclaimer, the term of this patent is extended or adjusted under 35 U.S.C. 154(b) by 352 days.

(21) Appl. No.: 10/359,184

(22) Filed: Feb. 6, 2003

(65) Prior Publication Data

US 2004/0155895 A1 Aug. 12, 2004

(51) Int. Cl.[7] ..... G09G 3/36; G09G 5/02; G09G 5/10

(52) U.S. Cl. ..... 345/100; 345/88; 345/98; 345/690; 345/698; 345/699

(58) Field of Search ..... 345/88, 98, 100, 345/589, 690, 698, 699, 177; 382/299, 312; 348/163

(56) References Cited

U.S. PATENT DOCUMENTS 4,785,818 A * 11/1988 Hardin ..... 344/163
6,151,002 A * 11/2000 Kim ..... 345/699
6,181,318 B1 1/2001 Lim
6,377,713 B1 * 4/2002 Vuong ..... 382/299
6,631,217 B1 * 10/2003 Funatsu et al. ..... 345/177
6,720,972 B2 * 4/2004 Feintuch ..... 345/589
6,721,464 B2 * 4/2004 Pain et al. ..... 345/589
2002/0015110 A1 2/2002 Elliott

FOREIGN PATENT DOCUMENTS

TW 201861 3/1993

* cited by examiner

*Primary Examiner*—Bipin Shalwala
*Assistant Examiner*—David L. Lewis
(74) *Attorney, Agent, or Firm*—Birch, Stewart, Kolasch & Birch, LLP

(57) ABSTRACT

A method and apparatus for enhancing the resolution of a display unit by adding any one of the two-channels of the three primitive color (r1, g1, b1, r2, g2, and b2) signals output from the column driving unit and dividing the sum by 2, and generating a new channel between the two channels. Such channel outputs a new three primitive color (R1, G1, B1) signal. These three primitive colors are also located between the two pixels of the primitive image data matrix to improve the display resolution and image smoothness and to enhance the display quality by less channel of the column driving unit.

10 Claims, 6 Drawing Sheets

METHOD AND APPARATUS FOR IMPROVING RESOLUTION OF DISPLAY UNIT

FIELD OF INVENTION

The invention relates to a method and apparatus for improving resolution of a display unit, more particularly to a method and apparatus for improving display resolution, image smoothness, and display quality.

BACKGROUND OF THE INVENTION

It is known that the present display driving method makes use of a column driving unit and a row driving unit to drive the display device as shown in FIGS. 1 and 2. If the display unit allows the displayed graphics to have high-resolution pixels, the designer will adopt a piece of column driving unit 1 with a high channel number of 239 (RGB)=239×3, and a piece of row driving unit 2 with a channel number of 160 to drive a 239 (RGB)×160 matrix display unit 3 as shown in FIG. 1, or use a multiple pieces of column driving units 1 with a channel number of 120 (RGB)=120×3, and a piece of row driving unit 2 with a channel number of 160 to drive a 239 (RGB)×160 matrix display unit 3, and thus will cause an increase of production cost.

At present, an R.O. C. Patent with Publication No. 201861 entitled "Method and apparatus for smoothing and improving solution" converts the video data into digital signal, amplifies the signal, saves it in the video memory, read and add the data on the left and the right adjacent to the video data, and then divide the sum by a constant. Such device comprises a video memory, a timing control device, a horizontal scan device, a horizontal scan data memory, an arithmetic operation unit, a latch device, and a digital-analog converter. Its shortcoming relies on the complexity, uneasy-to-make, and relative high production cost.

Further, the U.S. Patent with Publication No. US2002/0015110A1 entitled "Arrangement of color pixels for full color imaging devices with simplified addressing" uses a special RGB color filter structure to work with the algorithm to achieve the purpose of reducing the column driving channels and improving the resolution. It shortcoming relies on the design has to include the color filter structure and makes the algorithm more complicated, which requires the special design of FPGA for the implementation.

Furthermore, the U.S. Pat. No. 6,181,318 entitled "Method and apparatus of converting graphic resolution of LCD" for a component using two methods: discrete cosine transform (DCT) and inverse discrete cosine transform to convert the display resolution. Its shortcoming relies on the complicated process of the data conversion, which generally has a significant delay.

SUMMARY OF THE INVENTION

The principal objective of the present invention is to overcome the above shortcomings of the traditional method and device by adding a pixel between two pixels of the primitive video data to improve the display resolution and image smoothness as well as the display quality. The present invention adopts the column driving unit with smaller number of channels to lower the production cost.

To achieve the aforementioned objective, the column driving unit and the row column driving unit will drive the display unit 3, and in the meantime, the pixel processing unit will capture and add the three primitive color (r1, g1, b1, r2, g2, b2) signals of the first and second channels, and divide the sum by 2, and then generate a new three primitive color (R1, G1, B1) signal between the first and second pixels of the three primitive color (r1, g1, b1, r2, g2, b2) signals; in the meantime, another pixel processing unit will capture and add the three primitive color (r2, g2, b2, r3, g3, b3) signals of the second and third channels, and divide the sum by 2, and then generate a new three primitive color (R2, G2, B2) signal between the second and third pixels of the three primitive color (r2, g2, b2, r3, g3, b3) signals; this pixel processing method can accomplish the purpose of improving the display resolution and smoothing the image.

To provide a further understanding of the present invention, the following detailed description illustrates embodiments and examples of the invention, this detailed description being provided only for illustration of the invention.

DETAILED DESCRIPTION OF THE PREFERRED EMBODIMENTS

Figure 3:
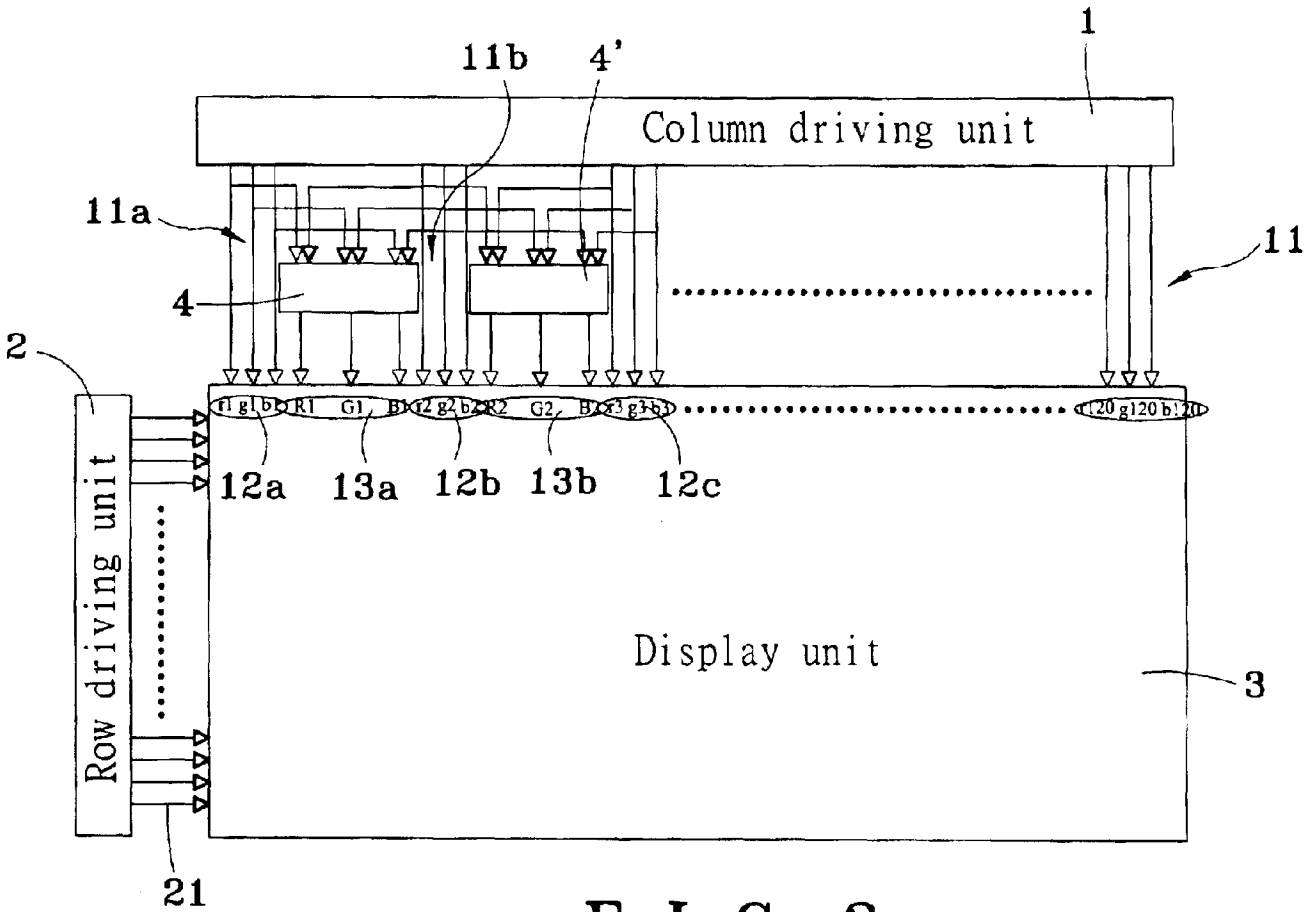
FIG. 3 is an illustrative diagram of the dot-matrix display unit structure of the present invention.

Refer to FIG. 3 for the illustrative diagram of the dot-matrix displaying structure of the present invention. In the figure, the method and apparatus of improving the resolution of the display unit of the present invention comprises the steps of using a unit between two pixels of the primitive video data matrixes to add the two pixels of the primitive video data and divide the sum, and then add the result between two pixels of the primitive video data matrix to improve the video smoothness and the display resolution; in the meantime, a column driving apparatus with less channels is chosen to lower the production cost.

To achieve the aforementioned objectives, the present invention adopts a method of using the pixels of the primitive image data matrix M(RGB)×N (where M is column, and N is row) and the desired pixel displaying to the dot matrix display unit is P(RGB)×N (where P is column, and N is row), wherein P>=M, 3×P−3×M=Q (increase number of channels is needed), and set the increased channel ratio A=3×P/Q and output a group of C for every 3A channels from the column driver IC. Each group of C will additionally generate a red dot (value of R), a green dot (value of G), and a blue dot (value of B), and the method of generating these dots is described as follows:

$R_{m,n}$=(Sum of r values of all red dots in Group $C_n$)/(number of r in Group Cn);

$G_{m,n}$=(Sum of g values of all green dots in Group $C_n$)/(number of g in Group Cn);

$B_{m,n}$=(Sum of b values of all blue dots in Group $C_n$)/(number of b in Group Cn);

M stands for the position of the column, and n for the position of the group of the row. Each group C will generate 3 additional channel data (dot R, dot G, and dot B) to attain the purpose of improving display resolution and image smoothness.

The devices adopted according to the above method of the present invention comprises a column driving unit 1, a row driving unit 2, a display unit 3 and a pixel processing unit 4, wherein:

the column driving unit 1 could be a column driving unit 1 with small number of channels or large number of channels for outputting a plurality of channels according to the specification to drive the display unit 2, and each channel 11 has three primitive colors (r1, g1, b1);

the row driving unit 2, for outputting a plurality of channels to drive the display unit 2;

the display unit 3, driven by the column driving unit 1 and the row driving unit 2;

the pixel processing unit 4, coupled between the column driving unit 1 and the display unit 3, for adding any one of the two channels of the three primitive color (r1, g1, b1, r2, g2, b2) signals and dividing the sum by 2, and then generating a new channel between the two channels, and such channel output a new three primitive color (R1, G1, B1) signal, and such three primitive colors (r1, g1, b1) is also located between two pixels of the primitive video data matrix;

When such device is operating, the column driving unit 1 and the row driving unit 2 will drive the display unit 3 through the plurality of channels 11, 21, and in the meantime, the pixel processing unit 4 will fetch and add the three primitive color (r1, g1, b1, r2, g2, b2) signals 12*a*, 12*b* of a first channel 11*a* and a second channel 11*b* and divides the sum by 2, and then generates a new primitive three color (R1, G1, B1) signal 13*a* between a first pixel signal 12*a* and a second pixel signal 12*b* of the three primitive color (r1, g1, b1, r2, g2, b2) signal 13*a*; in the meantime, another pixel processing unit 4' will fetch and add the three primitive color (r2, g2, b2, r3, g3, b3) signals 12*b*, 12*c* of a second channel 11*b* and a third channel 11*c* and divides the sum by 2, and then generates a new primitive three color (R2, G2, B2) signal 13*b* between a second pixel signal 12*b* and a third pixel signal 12*c* of the three primitive color (r2, g2, b2, r3, g3, b3) signal 13*b*; such pixel processing method can achieve the purpose of improving the display resolution and the image smoothness.

Figure 1:
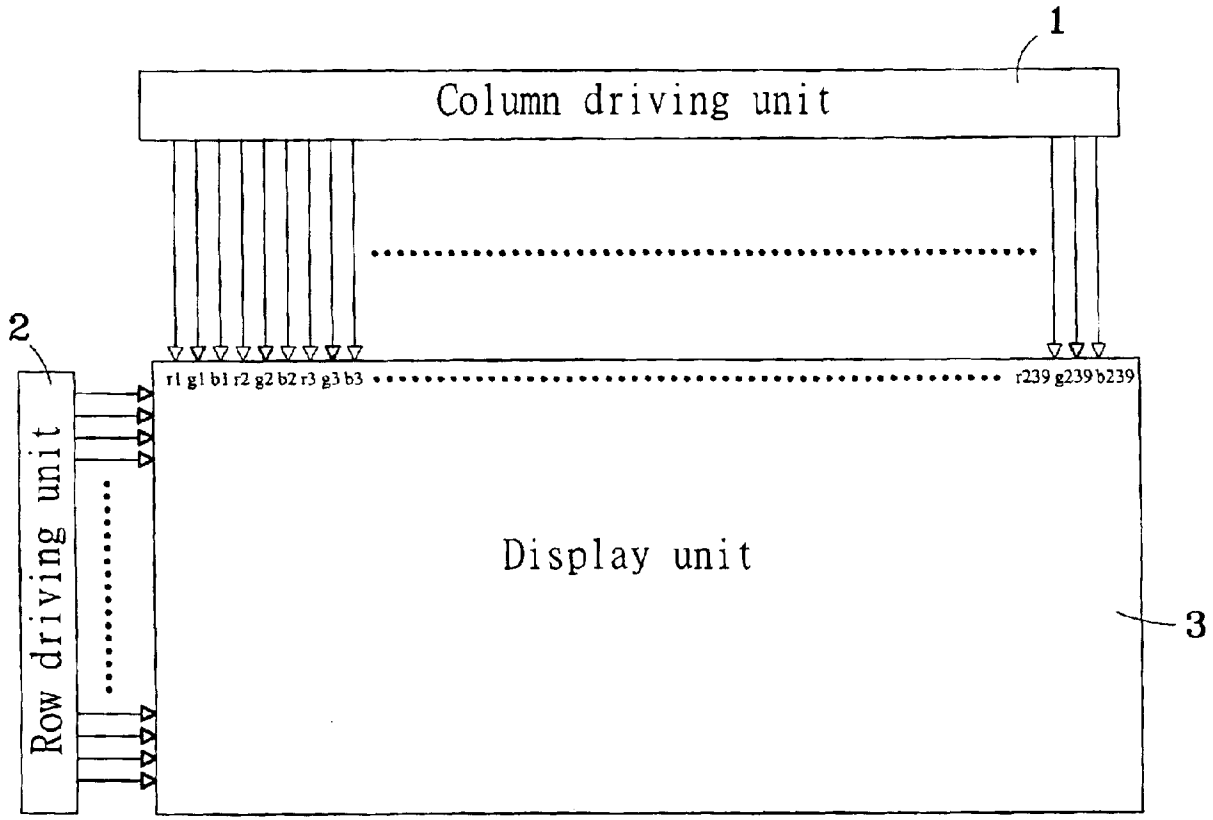
PRIOR ART FIG. 1
FIG. 1 is an illustrative diagram of the prior-art dot-matrix display unit structure.
Figure 2:
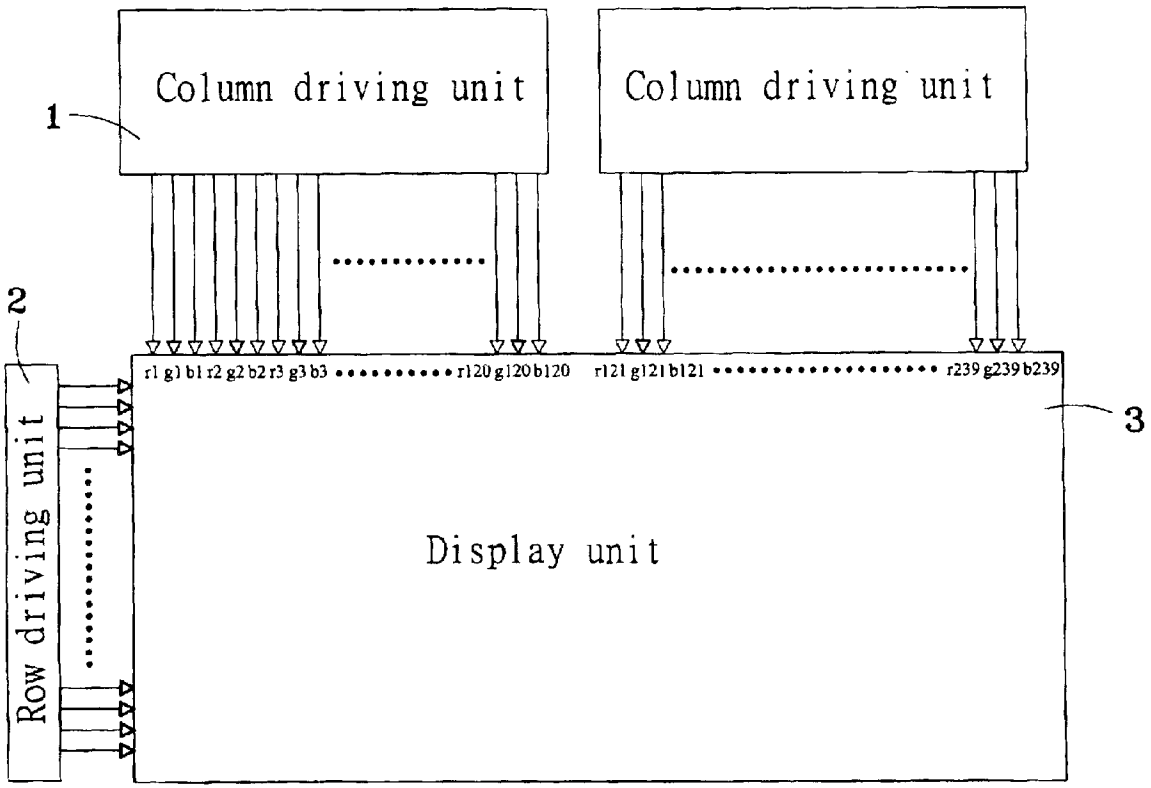
PRIOR ART FIG. 2
FIG. 2 is another illustrative diagram of the prior-art dot-matrix display unit structure.

Therefore, during the production, a column driving unit with small number of channels can be used. For example, FIG. 3 shows a pixel processing unit in accordance with the design of the present invention working with a piece of 120 (RGB)×3 channels column driver IC and a piece of 160 channels driver IC to accomplish the resolution as a single 239 (RGB)×160 or several 120 (RGB)×160 dot-matrix display unit as shown in FIGS. 1 and 2.

Figure 4:
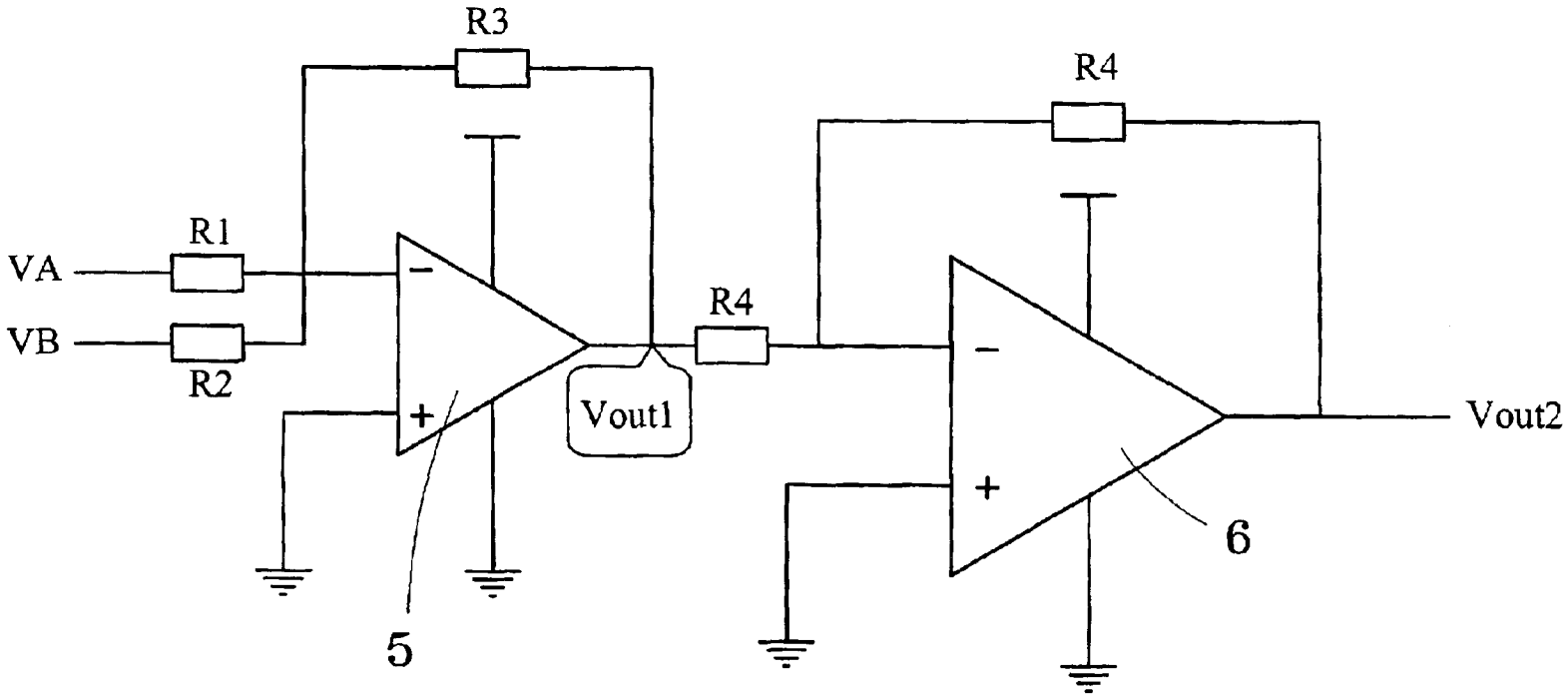
FIG. 4 is a schematic diagram of the circuit of the pixel processing unit in accordance with FIG. 3.

Please refer to FIG. 4 for the schematic diagram of the circuit of the pixel processing unit in accordance with FIG. 3 in detail. In the figure, the circuit comprises two pieces of amplifier (OPAMP) 5, 6; resistors R1, R2, R3, R4; R1=R2=2×R3; the first amplifier 5 works with R1, R2, R3 to make Vout1=−(VA+VB)/2 and the second amplifier 6 works with two R4 to make Vout2=(VA+VB)/2, and Vout2 is the new input voltage generated by the channel, and so forth. Each new generated channel requires such pixel processing unit 4.

Figure 5:
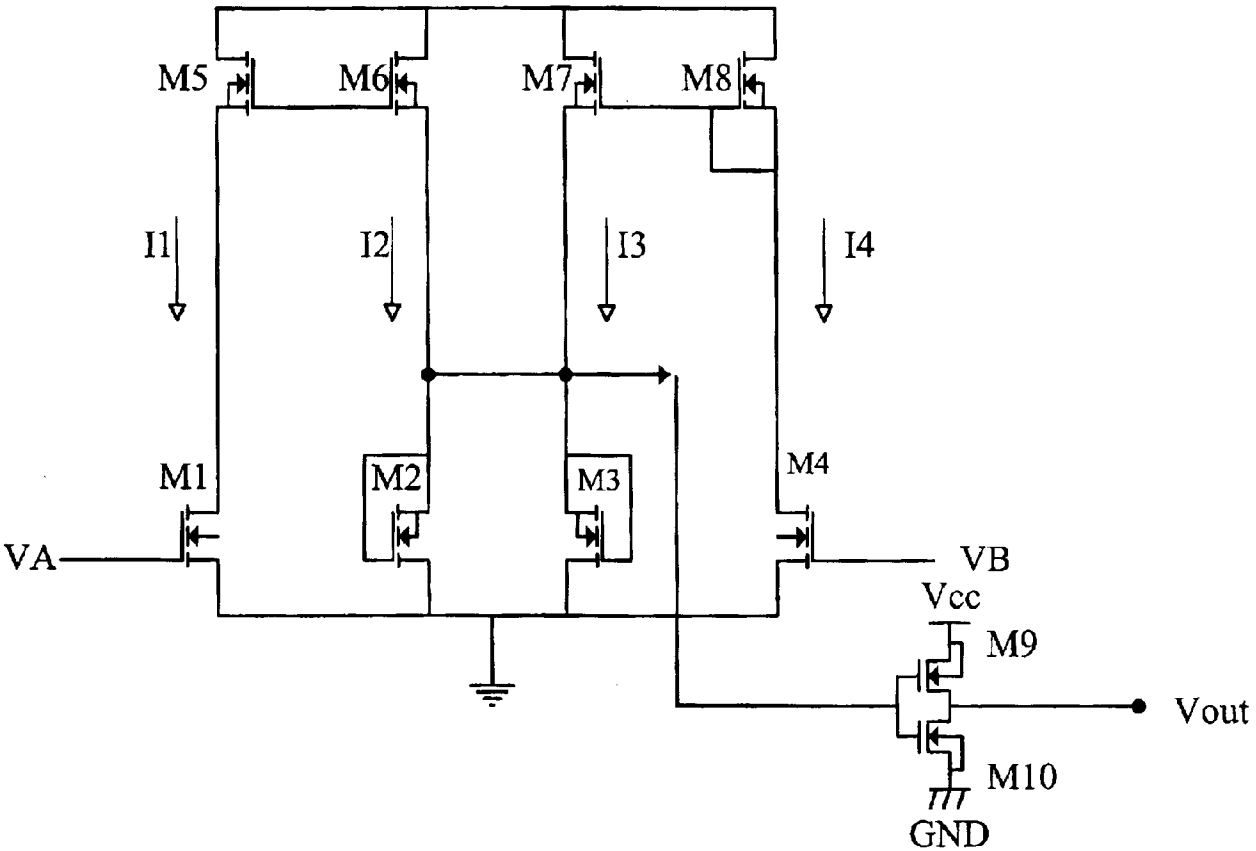
FIG. 5 is another schematic diagram of the circuit of the pixel processing unit in accordance with FIG. 3.

Please refer to FIG. 5 for another illustrative diagram of the circuit of the pixel processing unit in accordance with FIG. 3 in detail. In the figure, the present invention adopts 10 pieces of MOS transistors M1~M10, and M5 and M6 constitute a first set of Darlington configuration, and M7 and M8 constitute a second set of Darlington configuration; the current $I_1$ can make the current $I_2$=current $I_1$ through the first set of Darlington configuration, and the current $I_3$ can make the current $I_4$=current $I_3$ through the second set of Darlington configuration M1, M2, M3, and M4 act as resistors, and Vout=(VA+VB)/2 by adjusting the M1, M2, M3, and M4, and adding M9 and M10 enables Vout to have the driving power. Vout is the output voltage of the new generated channel. And so forth, each new generated channel requires such pixel processing unit.

Figure 6B:
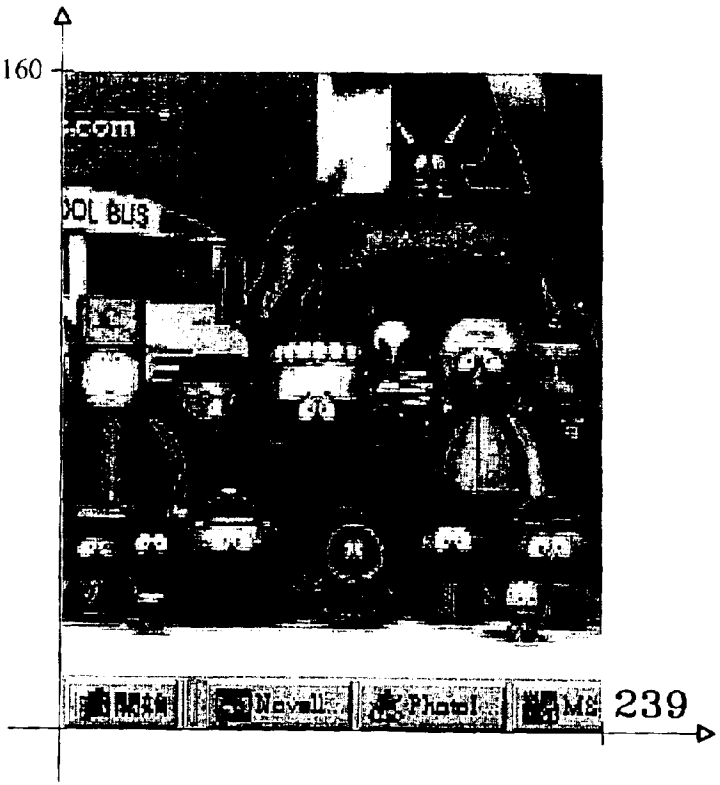
FIG. 6B is an illustrative diagram of the graphic after processing in accordance with the present invention.
Figure 6A:
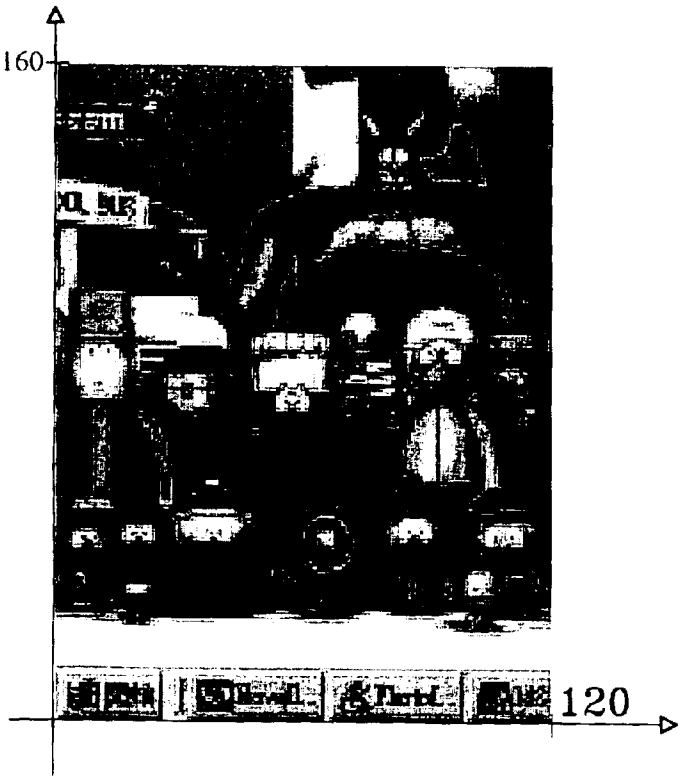
FIG. 6A is an illustrative diagram of the graphic before processing in accordance with the present invention.

Please refer to FIGS. 6A and 6B for the illustrative diagrams of the graphics before and after processing in accordance with the present invention. In the figure, the present invention converts the primitive graphic 120 (RGB)×160 onto the 239 (RGB)×160 dot-matrix display unit. In FIG. 3, Q=3×239−3×120=3×119, and the increase in channel ratio A=239×3/119×3=2; every 3×A=6 channels in the output channel of the column driving unit 1 is a group C. In each group C, an extra red dot (value of R), a green dot (value of G) and a blue dot (value of B) are generated. The method of generating these dots is described as follows:

Group C1 will generate:

R1, 1=(r1,1+r1,2)/(2);

G1, 1=(g1,1+g1,2)/(2);

B1, 1=(b1,1+b1,2)/(2);

Group C2 will generate:

R1,2=(r1,2+r1,3)/(2);

G1,2=(g1, 2+g1,3)/(2);

B1,2=(b1, 2+b1,3)/(2);

Group C3 will generate:

R1,3=(r1,3+r1,4)/(2);

G1,3=(g1,3+g1,4)/(2);

B1,3=(b1,3+b1,4)/(2);

Therefore, in each group C, 3 extra channel data (dot R, dot G, dot B) will be generated to achieve the objectives of improving the display resolution and smoothing the image.

Further, the pixel processing unit 4 of the present invention can be designed and placed on the glass baseboard of the display unit, or integrated into a single integrated circuit of the column driving unit 1.

What is claimed is:

1. An apparatus for improving resolution of a display unit, for improving resolution and smoothing image, comprising:

a column driving unit, having a plurality of channels, each channel having three primitive colors;

a row driving unit, having a plurality of channels, each channel having three primitive colors;

a display unit, coupled to said column driving unit and said row driving unit, and controlled by said column driving unit and said row driving unit;

a pixel processing unit, coupled between said column driving unit and said display unit, for adding any two channels of the three primitive color signals outputted from the column driving unit and dividing the sum by 2, and then generating a new channel between the two channels, and said channel outputting a new three primitive color signal, and said three primitive colors being located between two pixels of a primitive video data matrix.

2. The apparatus for improving resolution of a display unit of claim 1, wherein said column driving unit is a column driving unit with small number of channels.

3. The apparatus for improving resolution of a display unit of claim 1, wherein said pixel processing unit comprising two amplifiers and a plurality of resistor circuits.

4. The apparatus for improving resolution of a display unit of claim 3, wherein said first amplifier using Vout1=−(VA+VB)/2.

5. The apparatus for improving resolution of a display unit of claim 3, wherein said second amplifier converting Vout1=−(VA+VB)/2 into Vout2=−(VA+VB)/2, and Vout2 being the output voltage of a new generated channel.

6. The apparatus for improving resolution of a display unit of claim 1, wherein said pixel processing unit comprising 10 pieces of MOS transistor M1~M10 circuit.

7. The apparatus for improving resolution of a display unit of claim 1, wherein said M5 and M6 constituting a first set of Darlington configuration, said M7 and M8 constituting a second set of Darlington configuration; and a current $I_1$ making current $I_1$=current $I_2$ by the first set of Darlington configuration, and a current $I_3$ making current $I_3$=current $I_4$ by the second set of Darlington configuration; M1, M2, M3, and M4 acting as a resistor such that adjusting M1, M2, M3, and M4 makes Vout=−(VA+VB)/2, and adding M9 and M10 enables Vout to have a driving power, of which Vout being the output voltage of a new generated channel.

8. The apparatus for improving resolution of a display unit of claim 1, wherein said pixel processing unit is disposed on a glass baseboard of the display unit.

9. The apparatus for improving resolution of a display unit of claim 1, wherein said pixel processing unit is integrated into a single integrated circuit of the column processing unit.

10. A method improving resolution of a display unit, for improving resolution and smoothing image, said method comprising the steps of:

a) setting a pixel of a primitive video data matrix to M(RGB)×M;

b) setting a desired pixel displaying on a dot matrix display unit to P(RGB)×N;

c) for P>=M, 3×P−3×M=Q (which requires number of channels), setting and increasing channel ratio A=3×P/Q, and setting every 3×A channels of the output channel of the column driving unit as a group, and in every group, an extra red dot, a green dot, and a blue dot being generated, and the method of generating said dots including:

Rm,n=(adding the values of r of all red dots in Group Cn)/(number of values of r);

Gm,n=(adding the values of g of all green dots in Group Cn)/(number of values of g);

Bm,n=(adding the values of b of all blue dots in Group Cn)/(number of values of r); and 3 extra channel data being generated in every group to improve display resolution and smooth image.

* * * * *